US008323120B2

(12) United States Patent
Lorenzana

(10) Patent No.: US 8,323,120 B2
(45) Date of Patent: Dec. 4, 2012

(54) GOLF TRAINING DEVICE

(76) Inventor: Vance A. Lorenzana, Oswego, IL (US)

( * ) Notice: Subject to any disclaimer, the term of this patent is extended or adjusted under 35 U.S.C. 154(b) by 0 days.

(21) Appl. No.: 12/695,050

(22) Filed: Jan. 27, 2010

(65) Prior Publication Data

US 2011/0183772 A1 Jul. 28, 2011

(51) Int. Cl.
*A63B 69/36* (2006.01)

(52) U.S. Cl. ..... 473/280; 473/200; 473/569

(58) Field of Classification Search ..... 473/200, 473/280, 281, 351, 409, 588, 589, 595
See application file for complete search history.

(56) References Cited

U.S. PATENT DOCUMENTS

| | | | | | |
|---|---|---|---|---|---|
| 715,795 | A | * | 12/1902 | Haskell | 473/588 |
| 1,293,941 | A | | 2/1919 | Allston Sargent | |
| 1,790,762 | A | | 2/1931 | Page | |
| 1,922,735 | A | | 8/1933 | Johnson | |
| 2,264,802 | A | | 12/1941 | Kohl | |
| 2,494,929 | A | * | 1/1950 | Colaluca | 473/588 |
| 3,137,507 | A | | 6/1964 | Pickler | |
| 3,312,472 | A | * | 4/1967 | Kerr | 473/589 |
| 3,357,705 | A | | 12/1967 | Blanchard | |
| D220,769 | S | * | 5/1971 | LaHue | D21/709 |
| 3,796,435 | A | * | 3/1974 | Dale | 473/200 |
| 3,887,188 | A | * | 6/1975 | Beauchamp et al. | 473/446 |
| 4,776,596 | A | | 10/1988 | Nojima | |
| 4,940,238 | A | | 7/1990 | Bradley | |
| 5,228,696 | A | | 7/1993 | Gianferrara | |
| 5,377,988 | A | | 1/1995 | Westman | |
| 5,421,588 | A | * | 6/1995 | Browne | 473/588 |
| 5,480,143 | A | | 1/1996 | McMurry | |
| 5,595,546 | A | | 1/1997 | Masters | |
| 5,630,763 | A | | 5/1997 | Li-Tsan | |
| 5,718,642 | A | | 2/1998 | Cushing | |
| 5,759,109 | A | | 6/1998 | Martini | |
| 5,885,165 | A | | 3/1999 | Krause | |
| 6,004,220 | A | * | 12/1999 | Razzano | 473/200 |
| 6,012,997 | A | | 1/2000 | Mason | |
| 6,045,454 | A | | 4/2000 | Chu | |
| 6,729,969 | B2 | | 5/2004 | Fox | |
| 7,134,979 | B2 | * | 11/2006 | Edwards | 473/588 |
| 7,166,037 | B2 | | 1/2007 | Carter | |
| 7,195,564 | B2 | | 3/2007 | Han | |
| 7,300,357 | B2 | | 11/2007 | Breaker et al. | |
| 7,347,790 | B2 | | 3/2008 | Zimmerman | |
| 7,416,493 | B2 | | 8/2008 | Carter | |
| D586,419 | S | | 2/2009 | Tonkin | |
| 2003/0162603 | A1 | * | 8/2003 | Breaker et al. | 473/280 |
| 2006/0267273 | A1 | * | 11/2006 | Chen | 273/126 R |
| 2007/0093308 | A1 | | 4/2007 | Rice | |
| 2009/0118030 | A1 | | 5/2009 | Bernal-Silva et al. | |

* cited by examiner

*Primary Examiner* — Nini Legesse
(74) *Attorney, Agent, or Firm* — Erickson Law Group, PC

(57) ABSTRACT

A golf training method and device having at least one flat surface and an annular surface, wherein the annular surface is configured to receive contact with a golf club and the flat surface is configured to contact the surface on which the device is disposed. The device may have a radius greater than the height. The device may be sized to have the diameter of a standard regulation golf ball, and a height approximately 0.25 inches to require the user to swing within 0.25 inches precision in order to hit the training device. The device maybe made from a soft, resilient material suitable for use indoors.

13 Claims, 5 Drawing Sheets

GOLF TRAINING DEVICE

FIELD OF THE INVENTION

This invention relates in general to a golf training device, more particularly for practicing a golf swing.

BACKGROUND OF THE INVENTION

Various golf training devices are available for golf players to practice their golf swings. Training devices suitable for golf players at varying levels of skill are available, as often beginners and amateur players practice a different aspect of their golf swing than more seasoned players. Golf training devices are often projectiles which frequently incorporate characteristics that allow the device to simulate the feel, weight, and/or flight characteristics of a regulation standard golf ball to provide accurate informational feedback to the user regarding certain aspects of their golf swing.

Most beginner and amateur golfers suffer from hitting the golf ball "thin" or "fat." Hitting a golf ball thin, or topping the ball, results from the head of the golf club hitting the ball too high on the ball. Hitting the golf ball fat, or taking up a large divot with the golf club, results when the head of the golf club hits the ground before the golf club hits the golf ball. Accurate and precise golf swings which hit the golf ball "pure" or dead on require repeated and regular practice. However, frequent trips to a driving range or golf course may be costly and/or impractical for various reasons, especially if a user is just beginning to practice golf. Thus, it is often desirable to be able to practice golf in one's home, office, or yard.

Many factors are involved in perfecting a golf swing, such as the golfer's grip, stance, alignment, swing path, and point of impact with the golf ball. Many golf training devices require the user to simultaneously concentrate on numerous aspects of their golf swing, rather than allowing the user to focus on specific aspects of their golf swing, such as contacting the golf ball at a desired distance from the surface on which the golf ball rests, which is often a main concern for beginning and amateur golfers.

The present inventor has recognized the need for a durable, accurate training device for practicing a golf swing, which allows the user to focus on specific aspects of a golf swing.

The present inventor has recognized the need for a training device which can be used outdoors or indoors without damaging furniture, walls, or other items.

SUMMARY OF THE INVENTION

The invention comprises a golf training device for practicing golf swings by giving golfers a visual aid and training device to help the user hit a golf ball "pure" or dead on. The golf training device comprises a disk shaped body having at least one flat surface, and a cylindrical surface. In one embodiment, the device is made of a resilient material, such as rubber, so as to minimize damage to any surface with which the device comes into contact. The device has a height and a radius wherein the height is less than the radius.

In one embodiment, the training device has a diameter between 0.80 inches (20.32 mm) and 2.54 inches (64.52 mm) and a height between 0.125 (3.175 mm) and 0.25 (6.35 mm) inches. In another embodiment, the training device has a diameter between 0.80 inches (20.32 mm) and 2.54 inches (64.52 mm) and a height between 0.125 inches (3.175 mm) and a value less than the radius. In another embodiment, the disk has a diameter of 1.68 inches (42.67 mm), a radius of 0.84 inches (21.34 mm), and a height of 0.25 inches (6.35 mm). In another embodiment, the training device has a diameter of not less than 1.68 inches (42.67 mm). In another embodiment, the training device has a diameter of that of a regulation golf ball as set by the United States Golf Association.

In an alternative embodiment, the golf training device comprises a disk shaped body with one flat surface, a cylindrical surface, and a stepped surface comprising of at least two surfaces each at a different distance from the flat surface, with each distance from the flat surface corresponding to the height of a portion of the cylindrical surface on which the golf club could make contact with the training device. In this embodiment, the user can rotate the device to change the degree of accuracy within which the user must swing to send the device into projectile motion. By providing only a limited height for making contact with the device, the user is required to practice honing in on the accuracy of their swing.

Numerous other advantages and features of the present invention will be become readily apparent from the following detailed description of the invention and the embodiments thereof, from the claims and from the accompanying drawings.

DETAILED DESCRIPTION

Figure 1A:
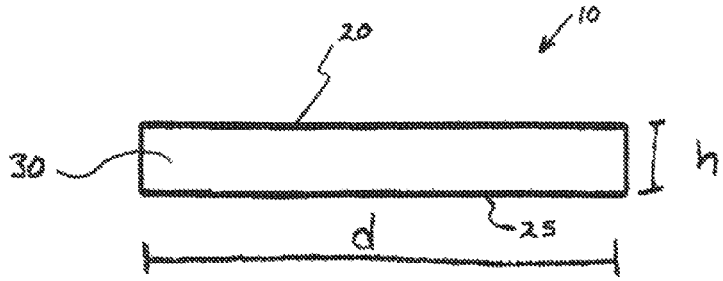
FIG. 1A is a side view of an exemplary embodiment of the golf training device.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 1B:
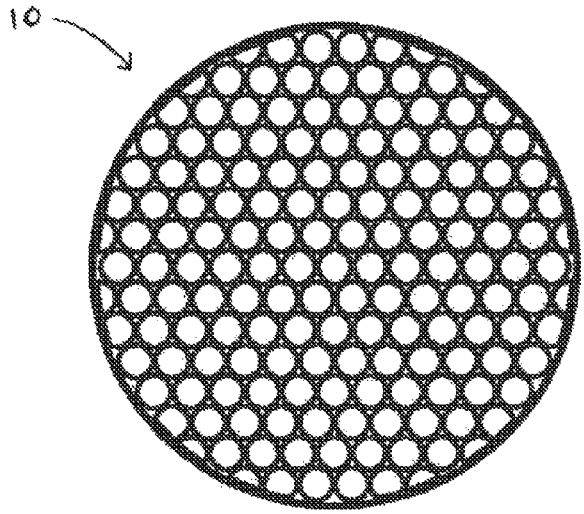
FIG. 1B is a top view of an exemplary embodiment of the golf training device.
Figure 2:
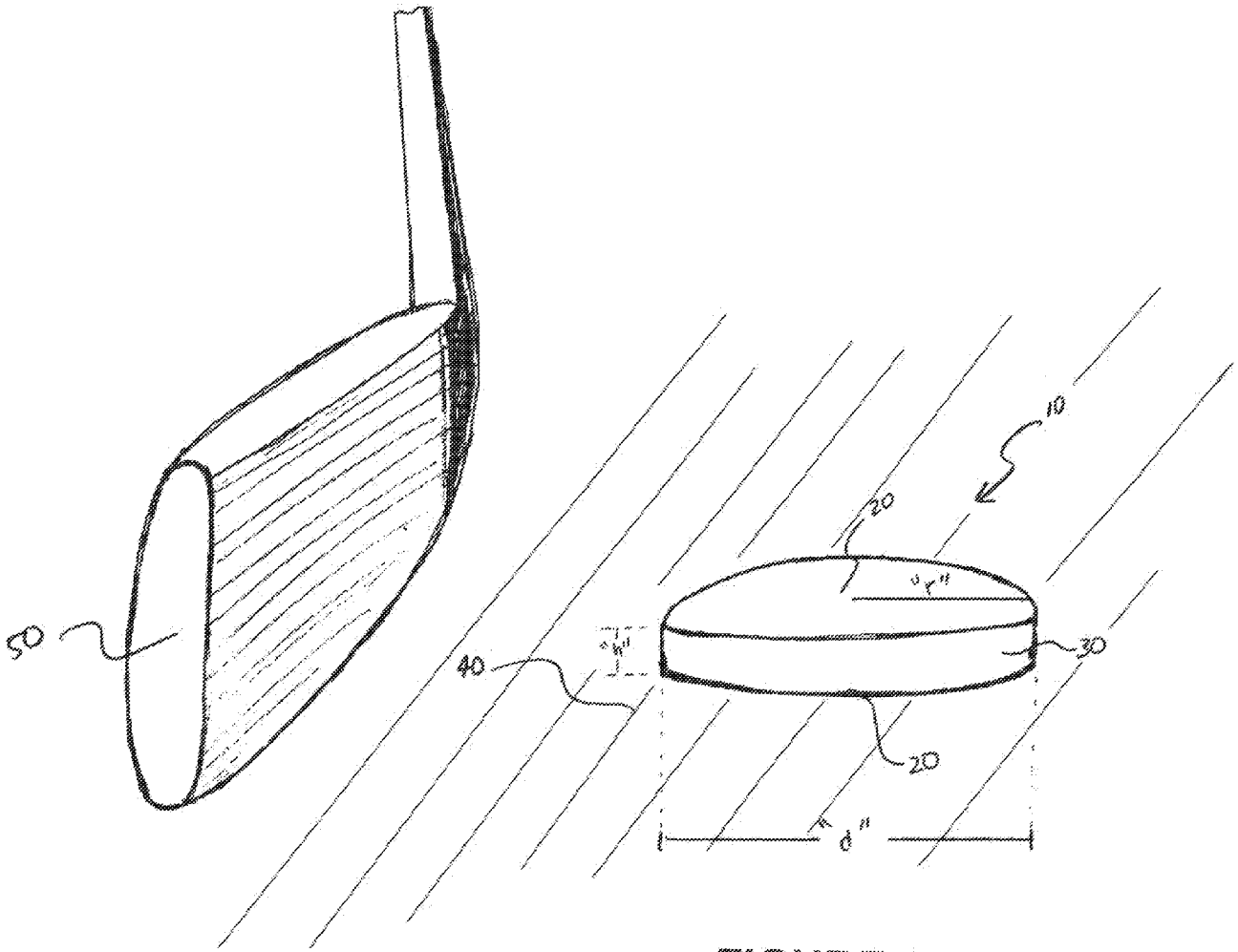
FIG. 2 is a perspective view of the golf training device in place for use.

FIGS. 1A and 1B illustrate the side and top views respectively of one embodiment of the golf training device. As illustrated in FIG. 2, the golf training device 10 is a disk shaped device comprising at least one flat surface 20 and a cylindrical surface 30. A second flat surface 25 is in contact with an operating surface 40. In one embodiment, the flat surfaces may include a pattern or texture, for example, to represent the dimples of a golf ball such as shown in FIG. 1B.

The golf training device 10 is made from a flexible and/or resilient material, such as, rubber, foam, silicone, plastic, resins, other polymeric or synthetic materials, or a combination thereof. This type of material allows the device to be used indoors such that upon impact, damage to walls or furniture is minimized. In one embodiment, the device is made of materials with resilient characteristics, such as rubber, or rubber-like compositions. Rubber materials or rubber-like compositions include synthetic rubbers, natural rubber, a combination of synthetic and natural rubbers, latex, and polyurethane.

In one embodiment, the device is made of foam, such as polyurethane, neoprene, and polyvinylchloride. The foam material should be of a sufficient density to allow the training device to launch into projectile motion upon contact to provide a visual indication of the general direction of launch. The foam material may be water resistant to be more adaptable to outdoor use.

The training device 10 can also be made from a combination of materials to achieve a desired weight or flight characteristic. For example, the flat surfaces 20, can be made of the same or different material, and the cylindrical surface 30 can be made from the same or different material as either of the two flat surfaces. In another embodiment, the outer surface layer may be a different material from the inner surface. In one embodiment, a softer outer surface may be disposed around an inner material that is denser.

As illustrated in FIGS. 1A and 2, the training device 10 has a diameter "d," height "h," and a radius "r." The golf training device has a height "h" less than the radius "r".

In one embodiment, the training device has a diameter between 0.80 inches (20.32 mm) and 2.54 inches (64.52 mm) and a height between 0.125 (3.175 mm) and 0.25 (6.35 mm) inches. In another embodiment, the training device has a diameter between 0.80 inches (20.32 mm) and 2.54 inches (64.52 mm) and a height between 0.125 inches (3.175 mm) and a value less than the radius. In another embodiment, the training device has a diameter of 1.68 inches (42.67 mm) and a height of 0.25 inches (6.35 mm). In another embodiment, the training device has a diameter of not less than 1.68 inches (42.67 mm). In another embodiment, the training device has a weight of not greater than 1.620 ounces (45.93 grams). In another embodiment, the training device has a diameter of that of a regulation golf ball as set by the United States Golf Association. In another embodiment, the training device has a diameter of that of a regulation golf ball as set by the organization charged or generally recognized as setting standards related to golf ball size in the United States.

In operation, the user places the training device 10 on an operating surface 40 such that a flat surface 25 of the training device is in contact with the operating surface 40. The user positions the golf club 50 such that when the user swings the golf club, the golf club strikes the training device on its cylindrical surface 30. The operating surface 40 can be any firm surface, such as a golf practice mat, floor, carpet, asphalt, grass, or any other firm surface on which the device is disposed. The user positions them self and aligns the golf club the same way they would with a golf ball, and similarly takes a swing at the training device 10.

Figure 3B:
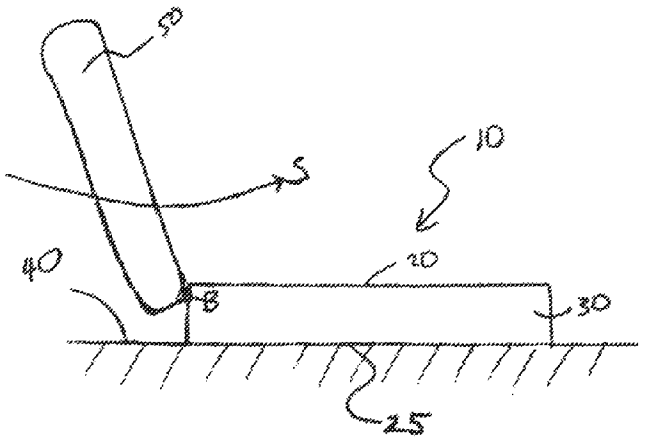
FIG. 3B is a side view of the golf training device in place for use.
Figure 3A:
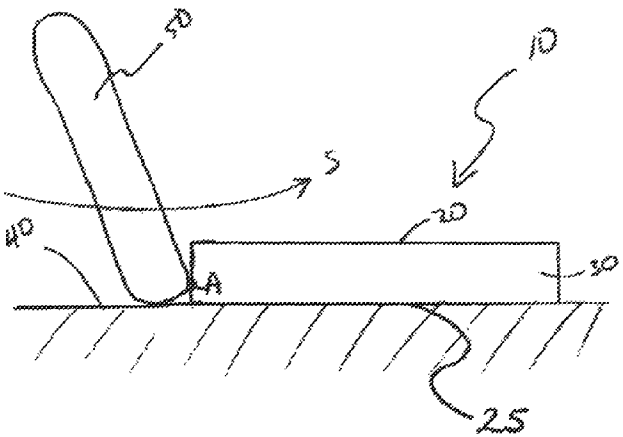
FIG. 3A is a side view of the golf training device in place for use.

FIGS. 3A and 3B illustrate a golf club being swung along curve S of a swing immediately before making contact with the training device 10. In FIG. 3B, the golf club 50 contacts the training device 10 at a higher point B on the cylindrical surface than point A in FIG. 3A. The height of the training device dictates the accuracy within which a swing needs to be executed in order to make contact with the training device and cause the training device to be launched. If the swing is "thin" the club head will go over the training device 10 without hitting it because the training device is only of a certain height. Conversely, if the user's swing is "fat" or hits the ground before it makes contact with the training device, the golf club will skip right over the training device without hitting the training device. Only by making contact with at least a portion of the height of the cylindrical surface 30 will the user cause the training device to launch as a projectile. Different embodiments of the training device each may have a different height to correspond to the configuration of the golf club or difficulty level desired by the user. A training device with a lesser height will be more difficult to hit and thus will require more accuracy in the user's swing.

Since a golf ball is spherical in shape, a rehearsed swing at the disk shaped training device with a cylindrical surface perpendicular to the ground will translate to a contact point on an actual golf ball that is at a different height on the golf ball than the height of the training device. The point of contact on the golf ball will be higher. By practicing swings at, for example, a training device having a height of 0.25 inches (6.35 mm), the rehearsed swing will translate to allowing the user to hit the golf ball at a desired contact point.

Figure 4:
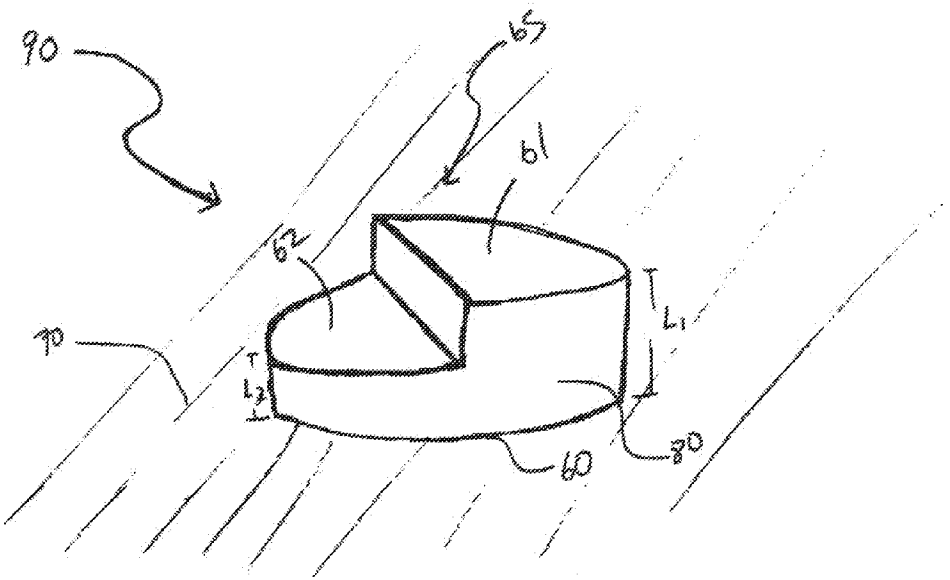
FIG. 4 is a perspective view of an alternative exemplary embodiment of the golf training device.

In an alternative embodiment as illustrated in FIG. 4, the training device comprises a disk shaped device 90 with one flat surface 60 which comes in contact with an operating surface 70, such as a golf practice mat, floor, carpet, asphalt, grass, or any other firm surface on which the device is disposed, and a cylindrical surface 80. The training device 90 further comprises a stepped surface 65 comprising a first partial surface 61 and a second partial surface 62 on the side of the training device opposite to bottom flat surface 60. First partial surface 61 has a height $L_1$ from bottom surface 60, while the second partial surface 62 has a height $L_2$ from bottom surface 60. Height $L_1$ and $L_2$ are different, so as to provide different heights with which a user can practice a golf swing within the same disk shaped device 90. Alternative embodiments can contain additional partial surfaces by, for example, dividing the stepped surface 65 into three or more partial surfaces. When using the training device 90, a user can place the training device 90 such that the cylindrical surface 80 with a greater height $L_1$ is facing the golf club. If the user desires a different difficulty level, the user can place the training device 90 such that the cylindrical surface 80 with a height $L_2$, which is less than that of height $L_1$, is facing the golf club since a cylindrical surface 80 with a lesser height will be more difficult to hit and thus require more accuracy in the user's swing.

Figure 5:
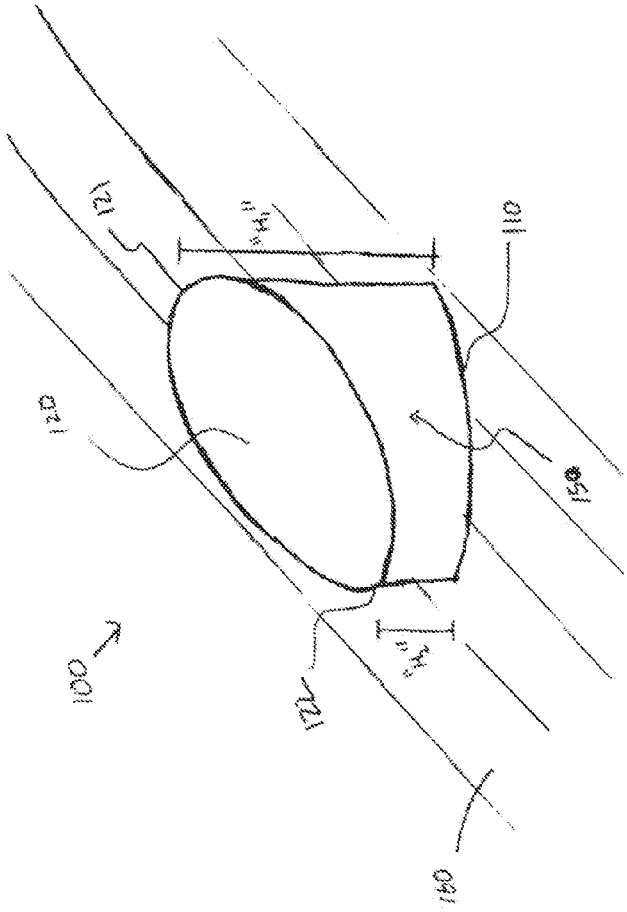
FIG. 5 is a perspective view of a second alternative exemplary embodiment of the golf training device.

In a second alternative embodiment, the training device comprises a device with one flat surface 110 which comes in contact with an operating surface 160 (FIG. 5). The training device 100 further comprises a second flat surface 120 disposed at an angle with respect to the first flat surface 110, and a cylindrical surface 150, The second flat surface 120 comprises an upper end 121 and a lower end 122. The upper end 121 has a height $H_1$ from the bottom surface 110, while the lower end 122 has a height $H_2$ from the bottom surface. Heights $H_1$ and $H_2$ are different so as to provide surfaces of different heights with which a user can practice a golf swing within the same device. If the user desires a different difficulty level, the user can place the training device 100 such that the cylindrical surface 150 with a height $H_2$, which is less than that of height $H_1$, is orientated to make contact with the golf club since a cylindrical surface 150 with a lesser height will be more difficult to hit and thus require more accuracy in the user's swing From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A golf training device comprising:

A flexible body having a first side which is a first flat surface, a second side, and a circumferential surface between the first side and the second side; said second side opposite the first side; said first side is adjacent to the circumferential surface, the circumferential surface configured to receive contact from a golf club, at least one of the first side and the second side is configured to support the body on an exterior support surface; the body has a diameter about equal to a diameter of a regulation golf ball;

the body having a cylindrical shape, the body having a body height and a radius, wherein the radius is greater than the body height; and wherein the body is solid throughout the cylindrical shape of the body between the first side and the second side; and the body height extends perpendicular to the first side, and the body height comprises a first height and a second height, the body has the first height along a first portion of the circumferential surface and the second height along a second portion of the circumferential surface opposite the first portion, the second height along the second portion is less than the first height along the first portion.

2. The golf training device of claim 1, wherein the body height extends perpendicular to the first side; and wherein the circumferential surface is a cylindrical outside wall.

3. The golf training device of claim 1, wherein the body height is between about 0.125 inches (3.175 mm) and a value less than the radius.

4. The golf training device of claim 1, wherein the diameter of the body is not less than 1.68 inches (42.67 mm).

5. The golf training device of claim 1, wherein the body has a weight of not greater than 1.620 ounces (45.93 grams).

6. The golf training device of claim 1 wherein the flexible body comprises a resilient material throughout the flexible body.

7. The golf training device of claim 1, wherein the flexible body comprises rubber throughout the flexible body.

8. A golf training device comprising:

a body with a body height and a width, the body height being less than the width, said body having a bottom flat wall, a top flat wall, and an outside cylindrical wall extending between the bottom flat wall and the top flat wall; the bottom flat wall is opposite the top flat wall, the top flat wall and the bottom flat wall are each perpendicular to the outside cylindrical wall, the outside cylindrical wall configured to receive contact from a golf club; the body comprises a resilient material throughout the body; the width of body is about equal to a diameter of a regulation golf ball;

at least one of the bottom flat wall and the top flat wall is configured to contact an exterior support surface, and the body is solid throughout the body between the bottom flat wall and the top flat wall;

the top flat wall is parallel to the bottom flat wall, the outside cylindrical wall forms a first edge where the outside cylindrical wall meets the top flat wall;

the outside cylindrical wall forms a second edge where the outside cylindrical wall meets the bottom flat wall;

the first and second edges are spaced apart across a height of the outside cylindrical wall; and, the top flat wall meets the outside cylindrical wall at the first edge and forms a first angle between the top flat wall and the outside cylindrical wall, and the bottom flat wall meets the outside cylindrical wall at the second edge and forms a second angle between the bottom flat wall and the outside cylindrical wall, the first angle and the second angle are each about 90 degrees and the outside cylindrical wall is straight between the first and second edges.

9. The golf training device of claim 8, wherein the width of the body is a diameter that is not less than 1.68 inches (42.67 mm).

10. The golf training device of claim 8, wherein the body is substantially the shape of a disk, wherein the disk has a thickness comprising the body height.

11. The golf training device of claim 8, the body height is between about 0.125 inches (3.175 mm) and a value less than a radius of the body.

12. The golf training device of claim 8, wherein the body has a weight of not greater than 1.62 ounces (45.93 grams).

13. A golf training device comprising:

A flexible body having a first side which is a first flat surface, a second side, and a circumferential surface between the first side and the second side; said second side opposite the first side; said first side is adjacent to the circumferential surface, the circumferential surface configured to receive contact from a golf club, at least one of the first side and the second side is configured to support the body on an exterior support surface; the body has a diameter about equal to a diameter of a regulation golf ball;

the body having a cylindrical shape, the body having a body height and a radius, wherein the radius is greater than the body height; and wherein the body is solid throughout the cylindrical shape of the body between the first side and the second side;

the body height extends across the circumferential surface perpendicular to the radius, and wherein the body height comprises a first height along a first portion of the circumferential surface and a second height along a second portion of the circumferential surface opposite the first portion, the second height along the second portion is less than the first height along the first portion.

* * * * *